United States Patent [19]

Tellie

[11] 3,952,440

[45] Apr. 27, 1976

[54] FIREARMS HAVING TWO ORIFICES FOR EJECTION OF THE EMPTY SHELLS

[76] Inventor: Paul E. Tellié, 20 rue Bergson, 42000 St. Etienne, France

[22] Filed: May 16, 1974

[21] Appl. No.: 470,460

[30] Foreign Application Priority Data

May 29, 1973 France ..... 73.19394

[52] U.S. Cl. ..... 42/1 R; 42/1 N

[51] Int. Cl.[2] ..... F41C 27/08

[58] Field of Search ..... 42/1 T, 1 R, 1 N, 25; 89/33 F

[56] References Cited

UNITED STATES PATENTS

| | | | |
|---|---|---|---|
| 1,515,415 | 11/1924 | Ronningen | 42/1 N |
| 2,940,201 | 6/1960 | Reed | 42/25 |
| 2,967,367 | 1/1961 | Ivy | 42/25 |
| 3,609,900 | 10/1971 | Bernocco, Jr. | 42/1 T |
| 3,755,946 | 9/1973 | Tomlinson et al. | 42/1 T |
| 3,791,060 | 2/1974 | Weaver | 42/25 |

*Primary Examiner*—Charles T. Jordan
*Attorney, Agent, or Firm*—Stevens, Davis, Miller & Mosher

[57] ABSTRACT

A firearm whose body has two opposite sides for the ejection of shells is provided with a removable hood having a lateral shield which permits the marksman to cover that one of the two orifices which is not in use. The upper portion of the hood has a convex curved shape corresponding to the shape of the upper wall of the firearm body but of slightly smaller cross-section. At the bottom of the lateral shield of the hood, a hook is provided to grip an edge at the base of the side wall. The hook acts as a hinge for the positioning of the hood by a transverse tilting movement accompanied by an elastic deformation due to expansion of the curved upper portion of the hood. The upper portion thus comes to cap over and elastically grip the curved upper portion of the body of the firearm.

11 Claims, 4 Drawing Figures

FIG. 1
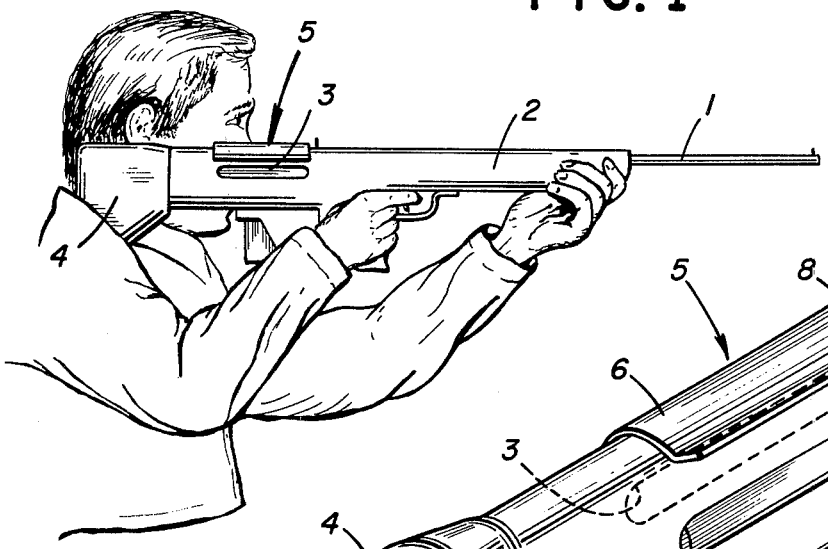
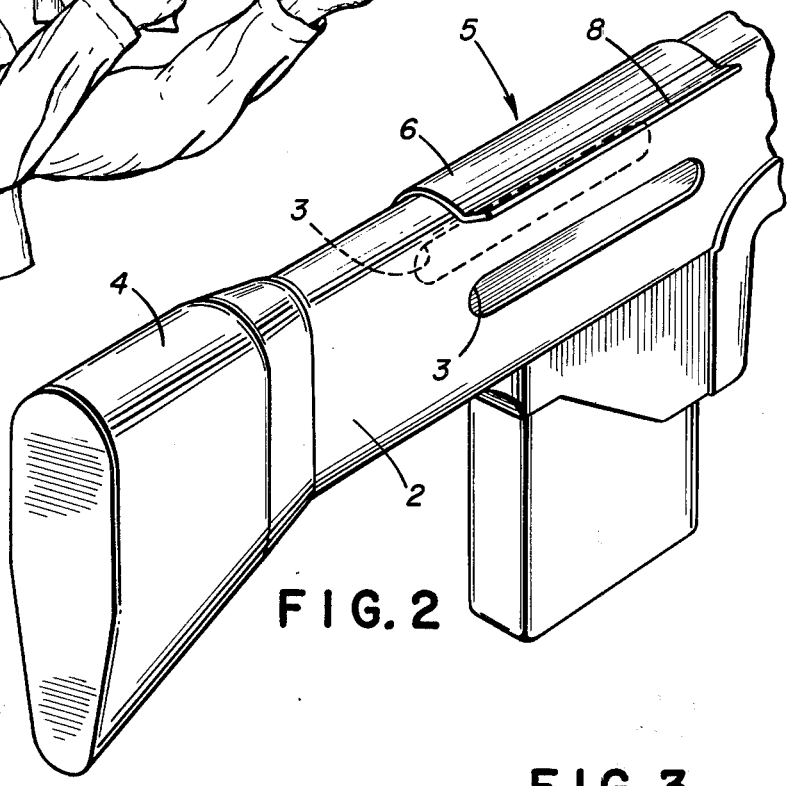
FIG. 2
FIG. 3
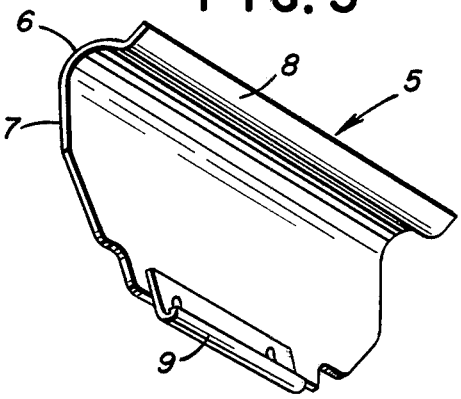
FIG. 4
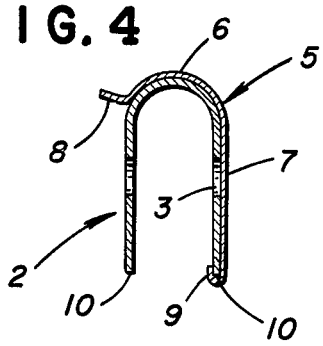

FIREARMS HAVING TWO ORIFICES FOR EJECTION OF THE EMPTY SHELLS

The present invention relates to firearms, and particularly automatic firearms, which are so arranged that the ejection of the empty shells can be effected through one or the other of two separate ejection orifices, the determination of the ejection orifice used resulting from a prior manipulation effected on the firearm itself.

Among firearms of this type, the invention relates more particularly but not exclusively to firearms of small caliber, and in particular portable firearms having a short butt-stock intended to be applied against the shoulder of the marksman upon firing, which is true of certain types of assault rifles or machine pistols.

Whatever the type and caliber of the firearm having two ejection orifices, the fact that one or the other of the orifices is not used upon a given firing has the drawback of leaving open one opening (namely the unused ejection orifice) through which foreign substances (dirt, sand, etc.) can penetrate in to the inside of the firearm, and in particular into its breech mechanism, and may possibly dirty the firearm and create diturbances which may even result in a failure to fire, making it necessary to take the breech mechanism apart.

Furthermore, in the case of a firearm intended to be fired from the shoulder and having two lateral ejection orifices, one on the right side and one on the left side, which are to permit its use by a left-handed marksman as well as by a right-handed marksman, it is advisable at any cost to avoid the ejection of the empty shells taking place on the side on which the marksman has his cheek, and thus run the risk of wounding him, which would be true if a left-handed person used the weapon of a right-handed person and forgot to carry out the prior selection maneuver intended to place the left-side ejection orifice into operation, which manipulation is, as a matter of fact, indispensable, since the right-handed marksman had, of course, set up his weapon in such a manner that the side ejection orifice used is the right-hand orifice, that is to say, the one located, with respect to the buttstock, on the side opposite the head of said right-handed marksman.

The object of the present invention is to provide a firearm having two ejection orifices, and in particular such a firearm with a short buttstock which does not have the drawbacks indicated above.

The firearm in accordance with the invention is a firearm (generally automatic and in particular of a portable type with short buttstock which can be brought to the shoulder) having two separate orifices for the ejection of the empty shells and having selector means making it possible for the marksman to use as desired one or the other of these two ejection orifices, the said firearm being characterized by the fact that it has closure means which can be actuated by the marksman and permit the latter to cover that one of the two ejection orifices which is not in use.

It will be realized that such closure means avoid the penetration of harmful external agents, such as dust and sand in particular, into the firearm.

Furthermore, in the case of a shoulder-borne firearm, it will be sufficient for the marksman to make certain that the ejection orifice located on his cheek side is properly masked by the closure means in question in order to be certain to avoid any risk of ejection of empty shells through said orifices, even if the orifice had been selected for use by the preceding marksman.

Preferably the said closure means consists of a single closure element which is capable of occupying, with respect to the body of the firearm, one or the other of two relative positions corresponding to the closure of one or the other respectively of the two ejection orifices.

Although one can then contemplate having the said closure element present permanently on the body of the firearm, for instance by pivoting it on the said body, it seems simpler and more advantageous to constitute it in the form of an independent removable element which can be attached to the body of the firearm in either of the two positions corresponding to the closure of one or the other of the two ejection orifices respectively.

In the case of a firearm having two opposite lateral ejection orifices arranged in the two side walls respectively of the body of the firearm, the removable single closure element can advantageously consist of a sort of hood which is symmetrical with respect to its central transverse plane and adapted to cap the upper portion of the said body at the level of the ejection orifices, the said hood being extended on one side by a rigid lateral shield which is capable, when the hood is in place, of completely masking the ejection orifice which is located on the same side as the said lateral shield.

This removable hood can be formed in particular of plastic material or of steel sheet, or of other metal or alloy.

It will be seen that it will be possible with such a symmetrical removable hood with a lateral shield to close the other ejection orifice by causing said hood to rotate first of all 180° around the vertical axis located in its central transverse plane of symmetry.

The holding in position of the removable hood is preferably effected without recourse to special fastening means. The holding in position is effected by imparting to certain longitudinal zones of the hood an elasticity which permits the said hood to cap and clamp, by a slight elastic deformation, around the portion of the body of the firearm to which it is secured.

For this purpose, the body of the firearm is provided, at the level of the lateral ejection orifices, with a convex curved upper wall (for instance of semi-cylindrical shape) and side walls provided at their base with a longitudinal element, such as, for instance, an edge capable of constituting a hooking base. The upper portion of the hood can be given a convex curved shape corresponding to the shape of the upper wall of the body of the firearm but of slightly smaller cross section. At the bottom of the lateral shield of the said hood, a device forming a hook adapted to grip the said longitudinal hooking element is provided to act as hinge for the positioning of the hood by a transverse tilting movement accompanied by an elastic deformation due to expansion of the curved upper portion of the said hood, which upper portion thus comes to cap over and elastically grip the curved upper portion of the body of the firearm.

In this case, in order to facilitate the release of the hood by a tilting movement in the opposite direction, one can advantageously provide along the free edge of the curved upper portion of the removable hood, that is to say, on the side opposite the shield, a longitudinal grasping tab which extends towards the outside. The tab, which is visible to the marksman in firing position, constitutes furthermore a member which indicates the side on which the unmasked ejection orifice is. In this connection it will be noted that the tab in question, if the removable hood is placed in the direction opposite the proper direction, will be on the same side as the cheek of the marksman and will warn the said marksman who is fully aware of the fact that his cheek must be in contact with a protective flat shield and not in contact with a protruding tab.

By way of illustration such a curved hood with shield and tab which is positioned by elastic pressure has a certain analogy, although for entirely different purposes, to covers of plastic material which serve to protect the semi-cylindrical curved grid of certain electric razors.

It should finally be pointed out that the outer face of the shield of the removable hood, which outer face constitutes a cheek-rest for the marksman, can be treated so as to improve the adherence of the cheek to said face, for instance by the formation of slight roughnesses or by covering it with a protective material such as a textile or synthetic covering.

In order to illustrate the various arrangements of the invention, there will now be described a preferred (but not limitative) embodiment of the said arrangements, with reference to the accompanying drawing in which:

FIG. 1 is a schematic view showing, in shoulder-borne position, an assault rifle with two orifices for the ejection of the empty shells in accordance with the invention, FIG. 2 shows, in perspective, on a larger scale, the rear portion of said rifle, FIG. 3 shows in a perspective view from below a removable hood intended to close one of the two orifices for the ejection of the empty shells, and FIG. 4 is a schematic cross section showing the said removable hood in one of the two positions which it can occupy on the forestock of the firearm.

The assault rifle shown in FIGS. 1 and 2 has a barrel 1 whose rear portion is surrounded by a forestock 2 serving as a support for the barrel and having two lateral orifices 3 for the ejection of the empty shells. The marksman determines in advance, depending on whether he is right-handed or left-handed, that one of the two orifices 3 through which the shells are to be ejected, this determination being possibly effected, for instance, and in known manner by changing the position of the extractor within the firearm. For a right-handed person, the lateral ejection orifice used will be the orifice located on the right, and for a lefthanded person the orifice located on the left.

This assault rifle has a short buttstock 4.

In accordance with the invention, closure means are provided to mask that one of the two orifices 3 which is not in use.

In accordance with the embodiment shown, these closure means consist of a removable hood 5 which is symmetrical with respect to its central transverse plane, the said hood being clearly shown in perspective in FIG. 3 and in cross section (in active position) in FIG. 4.

This hood 5 has a curved upper portion 6 which is adapted to cap elastically over the upper portion of the forestock 2, which is also curved, at the location of the ejection orifices 3. The said hood is extended on one side by a rigid lateral shield 7 capable of completely masking the ejection orifice 3 which is located on the same side as the said shield 7.

The hood 5 is provided on its free edge on the side opposite the shield 7 with a longitudinal grasping tab 8 which extends towards the outside, the said tab indicating to the marksman by its presence the side of the firearm on which the unmasked ejection orifice is located.

Finally, the lower edge of the lateral shield 7 is provided with an inwardly turned hook 9 adapted to grasp the lower edge 10 of the forestock 2 located on the same side. The entire hood 5 is held in place by the said hook (previously engaged on the said edge) and by its curved upper portion 6 which elastically caps over the upper portion of the forestock 2.

In FIGS. 1 and 2, the hood 5 is shown in position in which it closes the lefthand ejection orifice. In order to close the righthand ejection orifice, it would be sufficient elastically to release the hood 5, swing it 180° and attach it to the forestock 2 at the level of the orifices 3.

The outer face of the side shield 7 is hatched or striated in such a manner as to make it adhere better to the cheek of the marksman, for which in constitutes a resting surface.

As goes without saying, and as furthermore is already evident from the foregoing, the invention is in no way limited to that of its methods of application or to those of the embodiments of its various parts which have been more particularly indicated; rather, it covers all variants.

What is claimed is:

1. A firearm having two separate orifices for the ejection of empty shells so that a marksman can use as desired a selected one of either of the two ejection orifices, said firearm being provided with closure means, adapted to be actuated by the marksman, for closing that one of the two ejection orifices which is not in use.

2. A firearm as claimed in claim 1, wherein:

said closure means comprises a single closure element which is capable of occupying, with respect to the body of the firearm, either one of two relative positions, one of said positions corresponding to the closing of one of the two ejection orifices and the other of said positions corresponding to the closing of the other one of the two ejection orifices.

3. A firearm as claimed in claim 2, wherein:

the single closure element is a removable independent element capable of being fastened on the body of the firearm in either one of the two positions corresponding to the closing of the two ejection orifices respectively.

4. A firearm as claimed in claim 3, wherein:

said two separate orifices are two opposite lateral ejection orifices arranged in the two side walls of the body of the firearm respectively, said single closure element is a hood symmetric with respect to its central transverse plane and adapted to cap over the upper portion of the said body at the level of the ejection orifices, and said hood being extended on one side by a rigid lateral shield which is capable, when the hood is in place, of completely closing the ejection orifice present on the same side as said lateral shield.

5. A firearm as claimed in claim 4, wherein:

said closure hood has longitudinal areas which have an elasticity which permits the said hood to cap over and grip, with a slight elastic deformation, the portion of the body of the firearm on which it is fitted.

6. A firearm as claimed in claim 5, wherein:

the body of the firearm has, at the level of the lateral ejection orifices, a convex curved upper wall and side walls having at their base a longitudinal element which constitutes a hooking base, the closure hood comprises an upper portion of convex curved shape corresponding to the shape of the said upper wall but of slightly smaller cross section, and at the bottom of its lateral shield, a hook adapted to grip the said longitudinal element.

7. A firearm as claimed in claim 6, wherein:

the closure hood has, along the free edge of its curved upper portion, a longitudinal gripping tab.

8. A firearm as claimed in claim 7 wherein:

the closure hood is made of a plastic material.

9. A firearm as claimed in claim 7 wherein:

the closure hood is made of steel plate.

10. A firearm as claimed in claim 7 wherein:

the closure hood is made of metal.

11. A firearm as claimed in claim 7 wherein:

the closure is made of an alloy.

* * * * *